US006085652A

United States Patent [19]

Deschner et al.

[11] Patent Number: 6,085,652

[45] Date of Patent: Jul. 11, 2000

[54] INK FOUNTAIN WITH A FOUNTAIN ROLLER IN THE INKING MECHANISM OF PRINTING PRESSES

[75] Inventors: Jürgen Deschner, St. Leon-Rot; Andreas Schulz, Heidelberg, both of Germany

[73] Assignee: Heidelberger Druckmaschinen AG, Heidelberg, Germany

[21] Appl. No.: 09/137,790

[22] Filed: Aug. 21, 1998

Related U.S. Application Data

[63] Continuation of application No. 08/779,746, Jan. 10, 1997, abandoned.

[51] Int. Cl.[7] ..... B41F 31/02; B41F 3/81; B67D 5/08

[52] U.S. Cl. ..... 101/366; 101/148; 222/64; 33/713; 137/386

[58] Field of Search ..... 101/366, 365, 101/363, 364, 148, 207, 210, 356; 118/258, 259; 222/51, 64, 67, 65; 73/1.31, 290, DIG. 5; 401/194; 137/386, 101.25; 181/124; 33/713, 716, 721

[56] References Cited

U.S. PATENT DOCUMENTS

| | | | |
|---|---|---|---|
| 3,780,651 | 12/1973 | Black et al. | 101/364 |
| 3,848,529 | 11/1974 | Gegenheimer et al. | 101/363 |
| 4,099,461 | 7/1978 | Mitter | 101/119 |
| 4,787,313 | 11/1988 | Osborn et al. | 101/366 |
| 5,713,282 | 2/1998 | MacPhee | 101/148 |
| 5,724,890 | 3/1998 | Deschner et al. | 101/366 |

*Primary Examiner*—Kimberly L. Asher
*Attorney, Agent, or Firm*—Nils H. Ljungman and Associates

[57] ABSTRACT

An ink fountain with an ink-duct roller in the inking mechanism of printing presses, with a device for filling printing ink into the ink fountain, is described. The device for filling ink is mounted on a sled so that it can be moved back and forth in the longitudinal direction of the ink fountain. A sensor is fastened to the sled, and when the ink level is too low, the sensor controls the ink feed. Thereby, a precise regulation of the amount of ink added can be achieved by means of a downstream dosing device.

20 Claims, 2 Drawing Sheets

INK FOUNTAIN WITH A FOUNTAIN ROLLER IN THE INKING MECHANISM OF PRINTING PRESSES

CONTINUING APPLICATION DATA

This application is a Continuation application of U.S. patent application Ser. No. 08/779,746, filed Jan. 10, 1997, now abandoned, which claims foreign priority from Federal Republic of Germany Patent Application No. 196 00 796.8, filed Jan. 11, 1996.

CROSS REFERENCE TO RELATED PATENT

This application is related to U.S. Pat. No. 5,724,890, issued on Mar. 10, 1998 to inventors Deschner, et al., which is hereby incorporated by reference.

BACKGROUND OF THE INVENTION

1. Field of the Invention

This invention relates to an ink fountain with an ink-duct or fountain roller in the inking mechanism of printing presses, with a device for filling printing ink into the ink fountain, which device is mounted on a sled so that it can move back and forth in the longitudinal direction of the ink fountain, and with a sensor which is fastened to the sled and controls the ink feed when the level of ink is too low.

2. Background Information

The device for filling printing ink into the ink fountain, which device is mounted on a sled so that it can move back and forth in the longitudinal direction, can hold a cartridge, for example, from which the required ink is supplied. In this case, the cartridge can be changed easily, so that it is also possible to change to another ink without major effort.

OBJECT OF THE INVENTION

The object of this invention is to regulate the level of ink in the ink fountain in a manner which makes possible a precise dosing which corresponds to the respective ink requirement in the various zones.

SUMMARY OF THE INVENTION

The invention teaches that this object can be accomplished if a dosing device is located downstream of the device for filling the printing ink, by means of which dosing device the corresponding ink supply can be regulated as a function of the control signals emitted by the sensor. Using such a dosing device, it is possible to supply a precisely measured quantity of ink, even in brief intervals, without the occurrence of any undesirable run-on or dripping when the ink supply is shut off. It is thereby possible to react correctly to the control signals emitted by the sensor.

One advantageous embodiment of the invention is characterized by the fact that for the ink feed, there is an elastic molding on the device for filling the printing ink, which elastic molding corresponds to a transport star wheel with transport rollers which push the molding against a smooth molding abutment, and by the fact that the amount of ink supplied is dispensed in a measured and controlled quantity by rotating the transport star wheel by means of the transport rollers. As a result of the configuration of the dosing device in the form of a pump, any desired amount of ink can be dosed, without any undesirable run-on or dripping. An additional advantage of this configuration is that when the ink is changed, no parts of the dosing device need to be cleaned, because the elastic molding can also be replaced, which means that no additional cleaning effort is necessary.

An additional advantageous embodiment of the invention is characterized by the fact that the sensor is moved over or above the ink reservoir in the longitudinal direction of the ink fountain, and the filling opening of the ink feed device is moved over the cylindrical surface of the ink-duct roller in the longitudinal direction of the ink-duct roller. This embodiment has the advantage that the sensor detects the current condition of the ink reservoir, and if necessary, the quantity of ink supplied is applied to the cylindrical surface of the ink-duct roller. The quantity of ink supplied can therefore in no way influence the measurement result determined by the sensor. As a result of the movement of the sensor and of the filling opening in the longitudinal direction of the ink-duct roller, it is essentially guaranteed that the quantity of ink supplied is introduced into the ink reservoir only when the sensor is already at some distance from the feed location. During the next measurement and dosing process, the ink which is added is worked into the ink reservoir, and an exact measurement can be performed once again. As a result of the location of the sensor immediately next to the filling opening, a correct dosing of the amount of ink supplied can even be essentially guaranteed in the terminal areas of the ink fountain, where there is only a small ink space available.

One feature of the invention resides broadly in a device for filling a liquid into a liquid container in a printing press, the liquid filling device comprising: an outlet for dispensing liquid; a sensor for sensing a liquid level in a liquid container and for emitting a signal indicating the liquid level; a liquid dosing device disposed adjacent the liquid dispensing outlet for selectively regulating liquid flow through the liquid dispensing outlet; and the liquid dosing device comprising an arrangement for selectively regulating flow through the liquid dispensing outlet related to the liquid level signal emitted from the sensor.

Another feature of the invention resides broadly in a device for filling printing ink into an ink fountain in a printing mechanism of a printing press, the ink filling device comprising: an outlet for dispensing printing ink; a sensor for sensing an ink level in an ink fountain and for emitting a signal indicating the ink level; an ink dosing device disposed adjacent the ink dispensing outlet for selectively regulating ink flow through the ink dispensing outlet; and the ink dosing device comprising an arrangement for selectively regulating flow through the ink dispensing outlet related to the ink level signal emitted from the sensor.

Yet another feature of the invention resides broadly in an ink fountain in a printing mechanism of a printing press, the ink fountain comprising: a fountain roller having a longitudinal direction along a longitudinal axis; a device for filling printing ink into the ink fountain; the ink filling device comprising an outlet for dispensing printing ink; a sensor for sensing an ink level in the ink fountain and for emitting a signal indicating the ink level; an ink dosing device disposed adjacent the ink dispensing outlet; and the ink dosing device comprising an arrangement for regulating ink flow from the ink dispensing outlet related to the ink level signal emitted from the sensor.

BRIEF DESCRIPTION OF THE DRAWINGS

The present invention is explained in greater detail with reference to the accompanying drawings, in which.

DESCRIPTION OF THE PREFERRED EMBODIMENT

Figure 1:
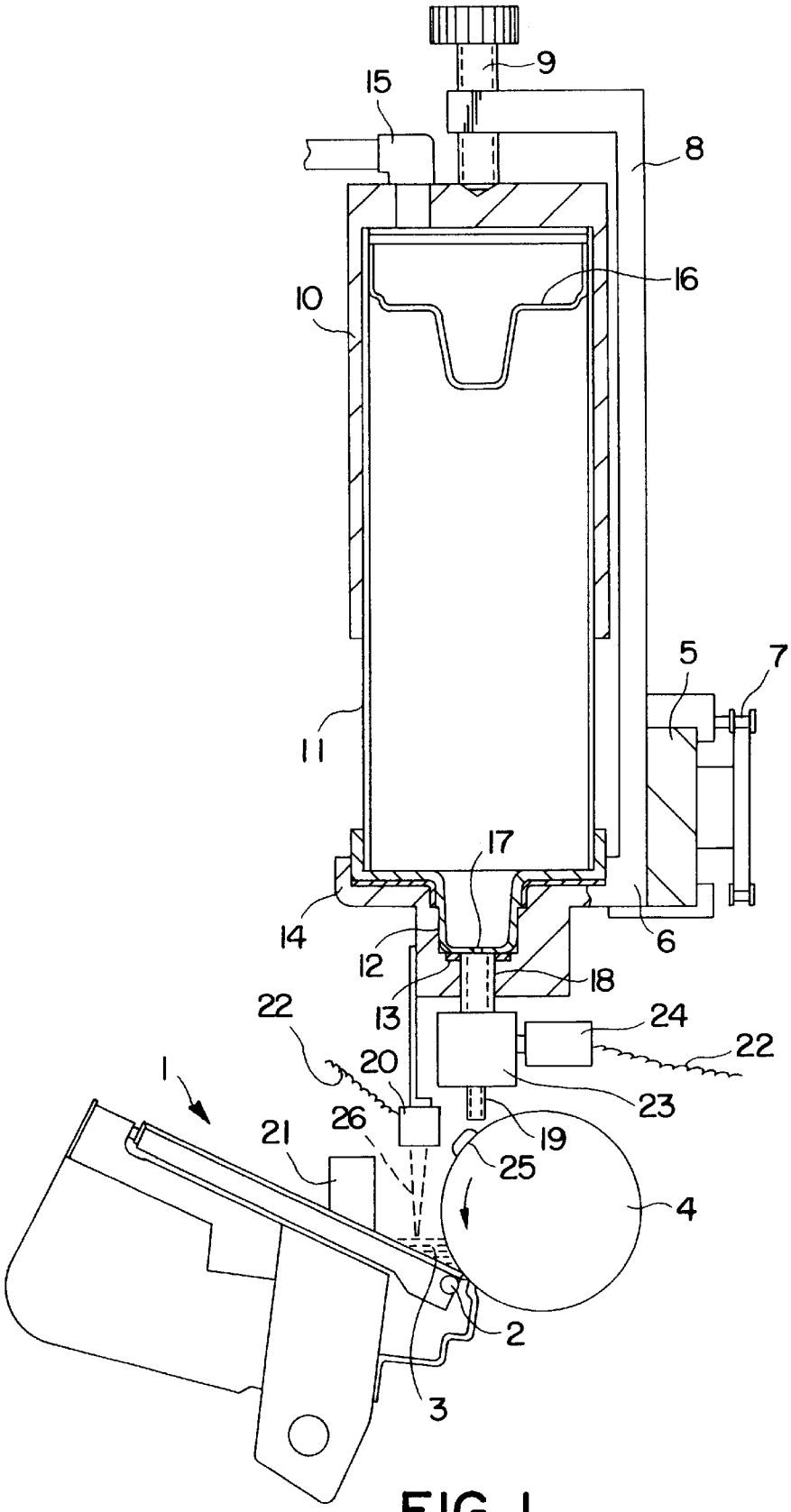
FIG. 1 is a schematic illustration of one embodiment of the invention.

In an ink fountain 1 with an ink profile dosing device 2 there is a small ink reservoir 3, whereby by means of the ink profile dosing device 2 an ink profile is produced on a fountain roller or ink-duct roller 4, which ink profile is then transported into the inking mechanism of a printing press. The ink space for the ink reservoir 3 can thereby be limited by a strip 21, so that the printing press can be operated with a minimum ink reservoir in the ink fountain 1.

A sled 6 is guided on a cross arm 5 which is fastened between side frames of the printing press. The sled 6 is moved back and forth over the length of the ink fountain 1 by means of a drive mechanism 7. In the sled 6, by means of an arm 8 and a clamping screw 9, a cap 10 is pressed onto a cartridge 11, so that the cartridge 11 with its discharge tube 12 is pressed by means of a gasket 13 onto the locator 14 of the sled 6. By means of a compressed air connection 15, the base 16 of the cartridge 11 can be moved downward with an adjustable pressure, so that ink can flow via the discharge opening 17. Below the cartridge 11, a feed tube 18 is fastened to the sled 6 in alignment with the discharge opening 17.

In the illustrated embodiment, fastened to the sled 6 is a sensor 20 which determines the current condition of the ink reservoir 3 in the individual areas, and if there is too little ink emits a signal which causes ink to be refilled. In the illustrated embodiment, there is an outlet dosing device 23 on the feed tube 18, which dosing device 23 can be actuated by means of an actuator motor 24, for example. Both the sensor 20 and the actuator motor 24 are connected by means of electrical lines 22 to an electronic control system which controls the actuator motor 24 as a function of the control signals emitted by the sensor 20, so that when the ink reservoir 3 is too low, a specified amount of ink 25 is applied via the feed opening or outlet 19 to the cylindrical surface of the ink-duct roller 4. As a result of the rotation of the ink-duct roller 4, this fresh amount of ink 25 is quickly introduced into the ink reservoir 3. The measurement beam 26 of the sensor 20 thus always determines the current status of the ink reservoir 3.

That is, the advantage of dispensing the ink onto the ink-duct roller 4 is that the added ink 25 is quickly combined with the ink in the ink reservoir 3 by the motion between the ink-duct roller 4 and the ink reservoir 3. If the ink were added directly to the top of the ink reservoir 3, a localized high area of ink may result on the top of the ink reservoir 3. This high area may not be indicative of the ink level at that point along the ink-duct roller 4, so that the sensor 20 may not read the ink level accurately. By depositing the added ink 25 onto the ink-duct roller 4, the surface of the ink reservoir 3 in any zone remains substantially level, so that the accuracy of of the sensor 20 is improved. In addition, by moving the outlet 19 above the fountain roller 4, the sensor 20 can be located in direct alignment with the outlet 19, rather than having the sensor 20 off to the side of the outlet 19, thereby permitting the outlet 19 to move the entire length of the ink reservoir without the interference of the sensor 20. The sensor 20 can prevent the outlet 19 from access to the ends of the ink reservoir 3, when the sensor 20 is mounted to the side of the outlet 19.

The dosing device 23 can be a hose pump or peristaltic pump, which are well known. These pumps make use of a resilient section of hose or tubing, such as the elastic molding discussed above. Typically, the resilient tubing is pinched between a conveying member and a stationary abutment. The conveying member is typically a rotary member with a plurality of radial extensions, which radial extensions push the tubing against the smooth abutment as the rotary member rotates, thereby pushing the fluid within the tubing in the direction of rotation of the rotary member. The extensions typically have rollers on the ends to reduce friction between the extensions and the tubing, so that less wear occurs and less energy is required. After the roller of the rotary member compresses the resilient tube, the resilient tube expands to allow the tube to refill with ink. Although it is helpful to have the resilient tube expand as a result of its own resiliency, the compressed air supplied through the compressed air connection 15 will reexpand most flexible or compressible tubings. A description and drawing of a peristaltic pump or hose pump can be found in "The Illustrated Science and Invention Encyclopedia", volume 14, pages 1884–1886, published by H. S. Stuttman Inc., Westport, Conn., 1983. In addition, some examples of peristaltic pumps and hose pumps which could possibly be used in the present invention can be found in the following U.S. Pat. Nos. 4,132,509; 4,214,855; 4,302,164; 4,483,666; 4,564,342; and 4,585,399.

Figure 2:
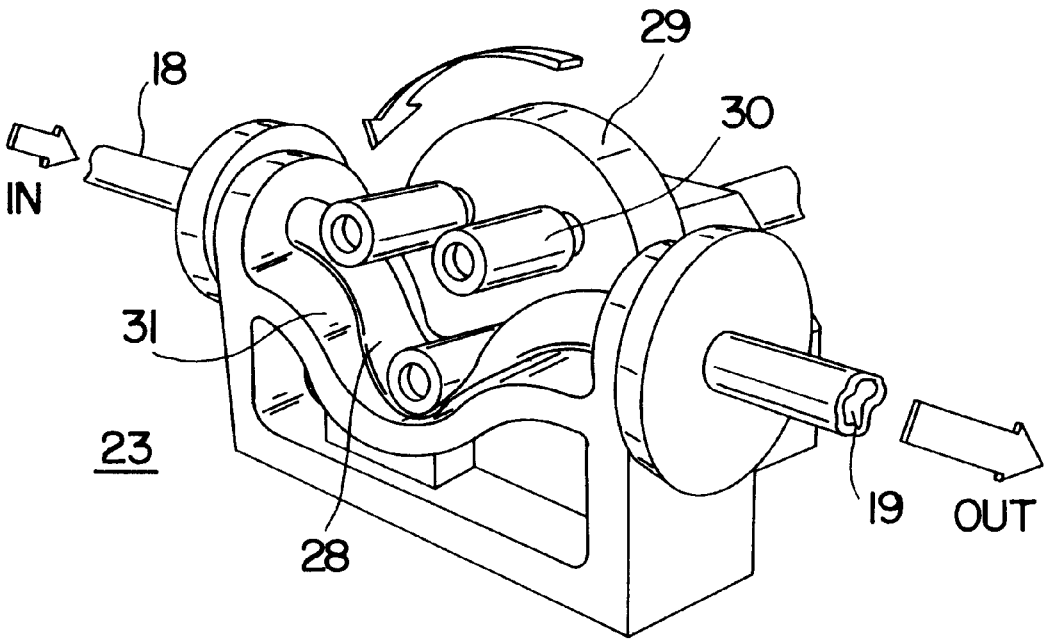
FIG. 2 is a drawing of a hose pump.

As shown in FIG. 2, the dosing device 23 can have an elastic molding or tube 28, corresponding to which there is a conveyor or transport star wheel 29 with transport rollers 30 which press the molding 28 against a smooth or soft molding abutment 31, so that the amount of ink 25 supplied is dosed by the rotation of the transport star wheel 29 by means of the transport rollers 30. A dosing device 23 designed in this manner therefore uses a type of hose pump which can be driven discontinuously by means of an actuator motor 24. Of course, other control means can also be used to dose the amount of ink 25 supplied.

The embodiment of the invention disclosed in FIG. 1 describes the feed tube 18 in alignment with the discharge opening 17 of the cartridge 11. Ink is dispensed from the feed opening 19. In the event of the dosing device 23 being a hose pump, a compressible tube must then be enclosed within the dosing device 23. One construction would involve a one-piece feed tube 18 having the feed opening 19 extending the entire way through the dosing device 23. Thus, the feed tube 18 could be replaced when a color change is made. Alternatively, the feed tube 18 and the cartridge 11 could be manufactured as a single unit, so that when the ink cartridge 11 is empty the entire unit is changed. Alternatively, the cartridge 11 could be refilled with ink. Additionally, the ink could pass through several components as the ink passes through the feed tube 18 and out the feed opening 19, so that the dosing device 23 surrounds a separate compressible tube component, which separate compressible tube component connects the feed tube 18 to the feed opening 19.

Examples of sensors and control systems using sensors can be found in the related U.S. Pat. No. 5,724,890, issued on Mar. 10, 1998 to inventors Deschner, et al.

One feature of the invention resides broadly in the ink fountain with ink-duct roller in the inking mechanism of printing presses, with a device for filling printing ink into the ink fountain, which device is mounted on a sled so that it can be moved back and forth in the longitudinal direction of the ink fountain, and with a sensor which is fastened to the sled and which controls the ink feed when the ink level is too low, characterized by the fact that downstream of the device for filling the printing ink there is a dosing device 23, by means of which the respective ink feed can be regulated as a function of the control signals from the sensor 20.

Another feature of the invention resides broadly in the ink fountain characterized by the fact that for the ink feed, there is an elastic molding on the device 23 for filling the printing ink, and corresponding to the elastic molding there is a transport star wheel with transport rollers which press the molding against a soft molding abutment, and that the amount of ink 25 fed in is dosed by the rotation of the transport star wheel by means of the transport rollers.

Yet another feature of the invention resides broadly in the ink fountain characterized by the fact that the sensor 20 is moved over the ink reservoir 3 in the longitudinal direction of the ink fountain 1, and the feed opening 19 of the ink feed device is moved above the cylindrical surface of the ink-duct roller 4 in the longitudinal direction of the ink-duct roller 4.

The appended drawings in their entirety, including all dimensions, proportions and/or shapes in at least one embodiment of the invention, are accurate and to scale and are hereby included by reference into this specification.

All of the patents, patent applications and publications recited herein are hereby incorporated by reference as if set forth in their entirety herein.

The corresponding foreign patent publication applications, namely, Federal Republic of Germany Patent Application No. 196 00 796.8, filed on Jan. 1, 1996, having inventors Jürgen Deschner and Andreas Schulz, and DE-OS 196 00 796.8 and DE-PS 196 00 796.8, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function.

The invention as described hereinabove in the context of the preferred embodiments is not to be taken as limited to all of the provided details thereof, since modifications and variations thereof may be made without departing from the spirit and scope of the invention.

NOMENCLATURE

1 Ink fountain
2 Ink dosing device
3 Ink reservoir
4 Ink duct roller
5 Crossbar
6 Sled
7 Drive mechanism
8 Arm
9 Clamping screw
10 Cap
11 Cartridge
12 Discharge tube
13 Gasket
14 Locator
15 Compressed air connection
16 Base
17 Outlet opening
18 Feed tube
19 Feed opening
20 Sensor
21 Strip
22 Line
23 Dosing device
24 Actuator motor
25 Quantity of ink
26 Measurement beam
27 Elastic tube
28 Transport star wheel
29 Transport roller
30 Smooth abutment

What is claimed is:

1. A method for supplying ink for an ink fountain in a printing mechanism of a printing press with a device for supplying ink, which ink fountain having a longitudinal dimension, said ink supply device comprising: a sensor arrangement being configured to emit signals to detect the level of ink in each of at least two zones of an ink fountain; said sensor arrangement being configured and disposed to sweep the surface of ink in each of at least two zones of an ink fountain, zone by zone, with said signals from said sensor, and determine a deviation from a desired ink level in each of the at least two zones; an ink dispensing arrangement; and said ink dispensing arrangement being configured to dispense ink to at least one zone of at least two zones of an ink fountain upon determining a low ink level in the at least one zone of the at least two zones; said method comprising the steps of:

determining a desired ink level in each of at least two zones of an ink fountain;

moving said ink supply device back and forth in the longitudinal direction along said ink fountain;

emitting signals with said sensor arrangement to detect the level of ink in each of said at least two zones;

sweeping the surface of ink in each of said at least two zones, zone by zone, with said signals from said sensor arrangement, by moving said sensor arrangement back and forth in the longitudinal direction along said ink fountain;

determining a deviation from the desired ink level in each of said at least two zones;

actuating said ink dispensing arrangement to dispense ink to at least one zone of said at least two zones upon determining a low ink level in said at least one zone of said at least two zones;

continuing dispensing ink to said at least one zone of said at least two zones having a low ink level;

continuing dispensing ink until a desired amount of ink is dispensed to said at least one zone of said at least two zones having a low ink level; and terminating dispensing ink upon dispensing of said desired amount of ink.

2. The method according to claim 1, wherein:

said step of moving said ink supply device back and forth along said ink fountain comprises moving a movable carriage, on which carriage said ink dispensing arrangement and said sensor arrangement of said ink supply device are mounted.

3. The method according to claim 2, wherein:

said step of dispensing ink to said at least one zone comprises dispensing ink directly onto a fountain roller of said ink fountain; and said step of dispensing ink directly onto said fountain roller comprises creating an ink profile directly on said fountain roller.

4. The method according to claim 3, further comprising:

rotating said fountain roller;

transporting said ink dispensed directly onto said fountain roller to said at least one zone by rotating said fountain roller;

combining said ink on said fountain roller with ink in said at least one zone by rotating said fountain roller; and maintaining the ink surface substantially level in said at least one zone by combining said ink on said fountain roller with ink in said at least one zone by rotating said fountain roller.

5. The method according to claim 4, wherein:

said step of dispensing ink to said at least one zone comprises regulating the amount of ink dispensed in relation to the ink level detected by said sensor; and said step of regulating the amount of ink dispensed comprises:

feeding the ink through a compressible tube of said ink dispensing arrangement;

rotating a roller device of said ink dispensing arrangement to press said compressible tube against a smooth abutment of said ink dispensing arrangement; and pressing said tube with said roller device to dose out an amount of ink from said ink dispensing arrangement.

6. A device for supplying ink for an ink fountain in a printing mechanism of a printing press, said ink supply device comprising:

a sensor arrangement being configured to emit signals to detect the level of ink in each of at least two zones of an ink fountain;

said sensor arrangement being configured and disposed to sweep the surface of ink in each of at least two zones of an ink fountain, zone by zone, with said signals from said sensor arrangement, and determine a deviation from a desired ink level in each of the at least two zones;

an ink dispensing arrangement; and said ink dispensing arrangement being configured to dispense ink to at least one zone of at least two zones of an ink fountain upon determining a low ink level in the at least one zone of the at least two zones.

7. The ink supply device according to claim 6, further comprising:

a movable carriage;

said movable carriage being configured to move back and forth in the longitudinal direction along an ink fountain having a longitudinal dimension; and said sensor arrangement and said ink dispensing arrangement being mounted on said movable carriage.

8. The ink supply device according to claim 7, wherein:

said ink dispensing arrangement being configured and disposed to dispense ink directly onto a fountain roller of an ink fountain to supply ink to at least one zone of at least two zones of the ink fountain; and said ink dispensing arrangement being configured and disposed to dispense ink directly onto a fountain roller of an ink fountain to create an ink profile directly on said fountain roller.

9. The ink supply device according to claim 8, wherein:

said ink dispensing arrangement being configured and disposed to dispense ink directly onto a fountain roller of an ink fountain to maintain the ink surface substantially level in at least one zone of an ink fountain by combining the ink on the fountain roller with the ink in the at least one zone.

10. The ink supply device according to claim 9, wherein:

said ink dispensing arrangement being configured to regulate the amount of ink dispensed in relation to the ink level detected by said sensor arrangement; and said ink dispensing arrangement comprising:

a compressible tube;

said compressible tube being configured and disposed to permit flow of ink from said ink dispensing arrangement;

a roller device;

a smooth abutment; and said roller device being configured and disposed to rotate to press said compressible tube against said smooth abutment to dose out an amount of ink from said ink dispensing arrangement.

11. A method for supplying ink for an ink fountain in a printing mechanism of a printing press with a device for supplying ink, said method comprising the steps of:

determining a desired ink level in each of at least two zones of an ink fountain;

emitting signals with a sensor arrangement to detect the level of ink in each of said at least two zones;

sweeping the surface of ink in each of said at least two zones, zone by zone, with said signals from said sensor arrangement;

determining a deviation from the desired ink level in each of said at least two zones;

actuating an ink dispensing arrangement to dispense ink to at least one zone of said at least two zones upon determining a low ink level in said at least one zone of said at least two zones;

continuing dispensing ink to said at least one zone of said at least two zones having a low ink level;

continuing dispensing ink until a desired amount of ink is dispensed to said at least one zone of said at least two zones having a low ink level; and terminating dispensing ink upon dispensing of said desired amount of ink.

12. The method according to claim 11, wherein said ink fountain has a longitudinal dimension, said method further comprising moving said ink dispensing arrangement back and forth in a longitudinal direction along the longitudinal dimension of said ink fountain.

13. The method according to claim 12, wherein:

said step of sweeping the surface of the ink in each of said at least two zones comprises moving said sensor arrangement back and forth in the longitudinal direction along the longitudinal dimension of said ink fountain.

14. The method according to claim 13, wherein:

said step of moving said ink dispensing arrangement back and forth along said ink fountain, and said step of moving said sensor arrangement back and forth along said ink fountain, in combination comprise moving said ink dispensing arrangement and said sensor arrangement together on a moving device of said printing press.

15. The method according to claim 14, wherein:

said step of moving said ink dispensing arrangement and said sensor arrangement together on a moving device of said printing press comprises moving a movable carriage, on which carriage said ink dispensing arrangement and said sensor arrangement are mounted.

16. The method according to claim 15, wherein:

said step of dispensing ink to said at least one zone comprises dispensing ink directly onto a fountain roller of said ink fountain.

17. The method according to claim 16, wherein:

said step of dispensing ink directly onto said fountain roller comprises creating an ink profile directly on said fountain roller.

18. The method according to claim 17, further comprising:

rotating said fountain roller;

transporting said ink dispensed directly onto said fountain roller to said at least one zone by rotating said fountain roller;

combining said ink on said fountain roller with ink in said at least one zone by rotating said fountain roller; and maintaining the ink surface substantially level in said at least one zone by combining said ink on said fountain roller with ink in said at least one zone by rotating said fountain roller.

19. The method according to claim 18, wherein:

said step of dispensing ink to said at least one zone comprises regulating the amount of ink dispensed in relation to the ink level detected by said sensor.

20. The method according to claim 19, wherein:

said step of regulating the amount of ink dispensed comprises:

feeding the ink through a compressible tube of said ink dispensing arrangement;

rotating a roller device of said ink dispensing arrangement to press said compressible tube against a smooth abutment of said ink dispensing arrangement; and pressing said tube with said roller device to dose out an amount of ink from said ink dispensing arrangement.

* * * * *

UNITED STATES PATENT AND TRADEMARK OFFICE

CERTIFICATE OF CORRECTION

PATENT NO. : 6,085,652
DATED : July 11, 2000
INVENTOR(S) : Jurgen Deschner and Andreas Schulz It is certified that error appears in the above-identified patent and that said Letters Patent is hereby corrected as shown below:

Title page,
Immediately after item [22], insert the following information:

-- [30] Foreign Application Priority Data

| | | | |
|---|---|---|---|
| Jan. 11, 1996 | [DE] | Germany | 196 00 796.8 |
| Apr. 5, 1995 | [DE] | Germany | 195 12 727.7--. |

Signed and Sealed this

Twenty-first Day of August, 2001

*Attest:*

Nicholas P. Godici

*Attesting Officer*

NICHOLAS P. GODICI
*Acting Director of the United States Patent and Trademark Office*